United States Patent [19]

Olivari

[11] 4,217,672

[45] Aug. 19, 1980

[54] DEBRIS PICKER AND BAGGER

[76] Inventor: Humbert Olivari, 7200 Shady Villa La., Apt. 129, Houston, Tex. 77055

[21] Appl. No.: 937,302

[22] Filed: Aug. 28, 1978

[51] Int. Cl.[2] ..... E01H 1/04; A01G 1/12

[52] U.S. Cl. ..... 15/79 A; 15/79 R; 56/364

[58] Field of Search ..... 15/79 R, 79 A, 83; 56/364

[56] References Cited

U.S. PATENT DOCUMENTS

| | | | |
|---|---|---|---|
| Re. 2,192 | 3/1866 | Craven et al. | 56/364 |
| Re. 21,571 | 9/1940 | Innes | 56/364 |
| 1,919,896 | 7/1933 | MacGregor | 56/364 |
| 2,895,590 | 7/1959 | Snow | 56/364 X |
| 3,808,627 | 5/1974 | Doering et al. | 15/79 R X |
| 3,849,043 | 11/1974 | Doering | 15/79 R |
| 3,849,824 | 11/1974 | Doering | 15/79 R X |
| 3,926,108 | 12/1975 | Doering | 15/79 R X |

FOREIGN PATENT DOCUMENTS

| | | | |
|---|---|---|---|
| 1226352 | 10/1966 | Fed. Rep. of Germany | 56/364 |

*Primary Examiner*—Edward L. Roberts
*Attorney, Agent, or Firm*—Walter G. Finch

[57] ABSTRACT

The invention is an improved device for picking leaves, pine needles, and other debris from a lawn and bagging them for disposal. The device operates by the movement of a pair of wheels across the lawn, which in turn, by geared means, revolves a shaft carrying a plurality of rake-like tines or fingers. The rake-like members, on the revolving shaft, sweep and pick up leaves and other debris from a lawn and move them upward within the housing of the device. The rake-like members extend outwardly from the shaft and the ends pass through apertures in a drum. The drum is off-center in relation to the shaft of the rake-like members so that in the revolving of the mechanism the ends of the rake-like members move back and forth through the apertures in the drum. The leaves and other debris are moved and compacted into a disposal bag mounted to the upper side of the mechanism. The filled disposal bag is easily removed and replaced by an empty bag. Handle means are provided for manually pushing the device.

11 Claims, 17 Drawing Figures

DEBRIS PICKER AND BAGGER

BACKGROUND AND SUMMARY OF THE INVENTION

The invention relates to debris collectors or pickup devices and in particular to devices for collecting items from lawns, specifically, a leaf and other debris picking device that also discharges the collected debris into a bag for ready disposal.

Numerous types of debris collectors exist in the prior art that operate as lawn brooms, lawn sweepers, and other similar characterizations. The present invention is an improvement over the prior art in the manner of the operation in order to make it more efficient.

It is to be noted that the present invention actually is capable of collecting more than just leaves from a lawn. It will collect leaves, pine needles, cut grass, and other debris as well. Hereinafter the term "leaf-picker" is to be understood to include any of the aforesaid debris, such as, but not limited to, cut grass, pine needles, and other such debris.

The present invention operates without any suction or vacuum action to induce the leaves into the device. It operates by the movement rake-like members within an off-center drum.

The present invention is presented as a manually pushed or operated device. It is to be understood it could as well be mechanized to operate by a motorized means, electrical or fuel powered.

It is, therefore, an object of the invention to provide a debris picker and bagger that removes debris from a lawn by mechanical means.

It is another object of the invention to provide a debris picker and bagger that operates without the use of a vacuum or suction means.

It is still another object of the invention to provide a debris picker and bagger that uses rake-like members for the initial movement of debris from the lawn toward the mechanism for moving the debris into the device.

It is a further object of the invention to provide a debris picker and bagger with an offset drum in relation to the shaft of the rake-like members as a means for clearing the leaves from the rake-like members.

It is yet another object of the invention to provide a debris picker and bagger with a disposable bag mounted thereon to receive and hold the debris for easy disposal.

It is also an object of the invention to provide a debris picker and bagger that moves the collected debris vertically upward and then into a disposable bag mounted to the upper side of the mechanism for storage until disposal.

Further objects and advantages of the invention will become more apparent in light of the following description of the preferred embodiments.

DESCRIPTION OF THE PREFERRED EMBODIMENTS

Figure 1:
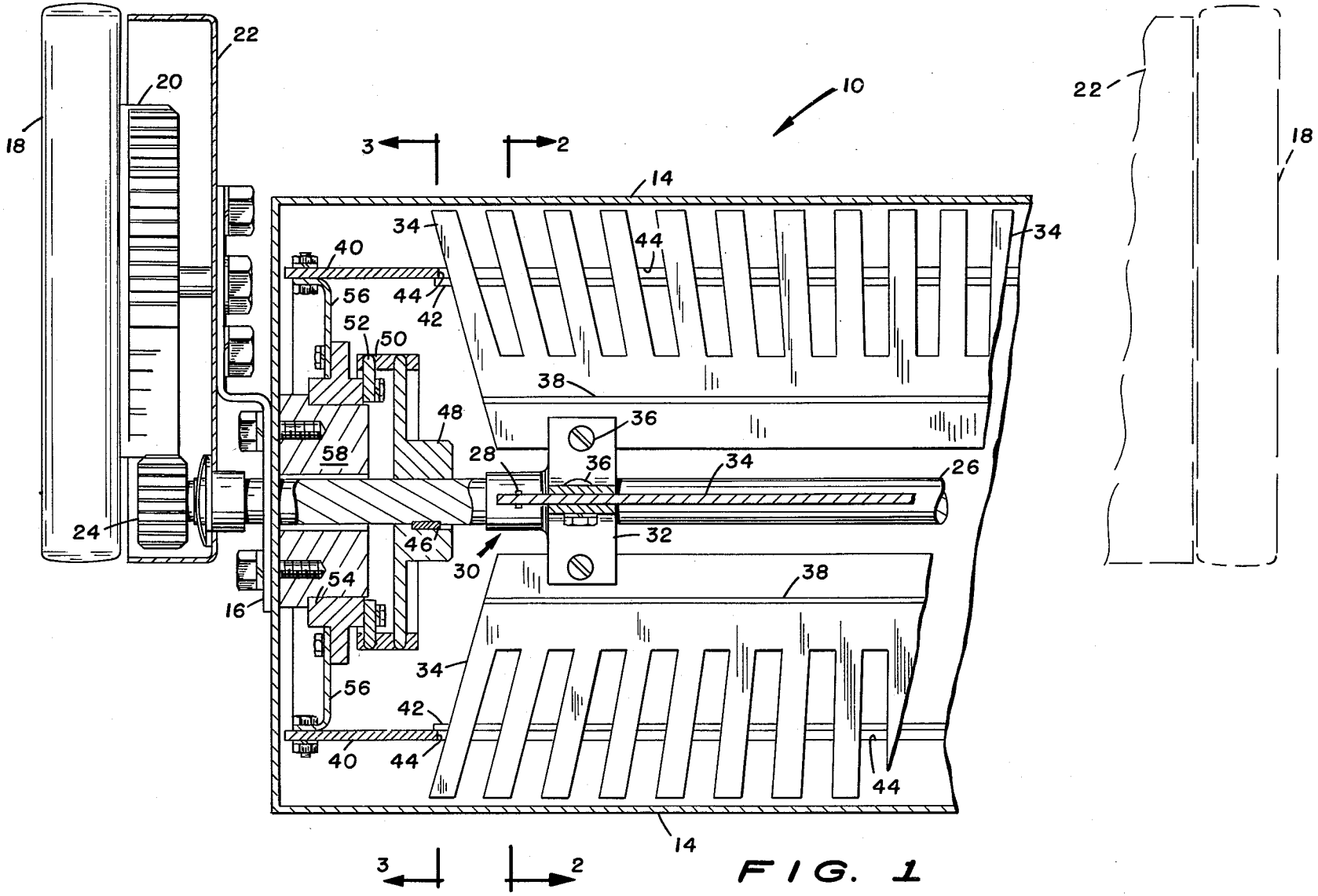
FIG. 1 is a top view in section, with one end in phantom, of the first embodiment.
Figure 6:
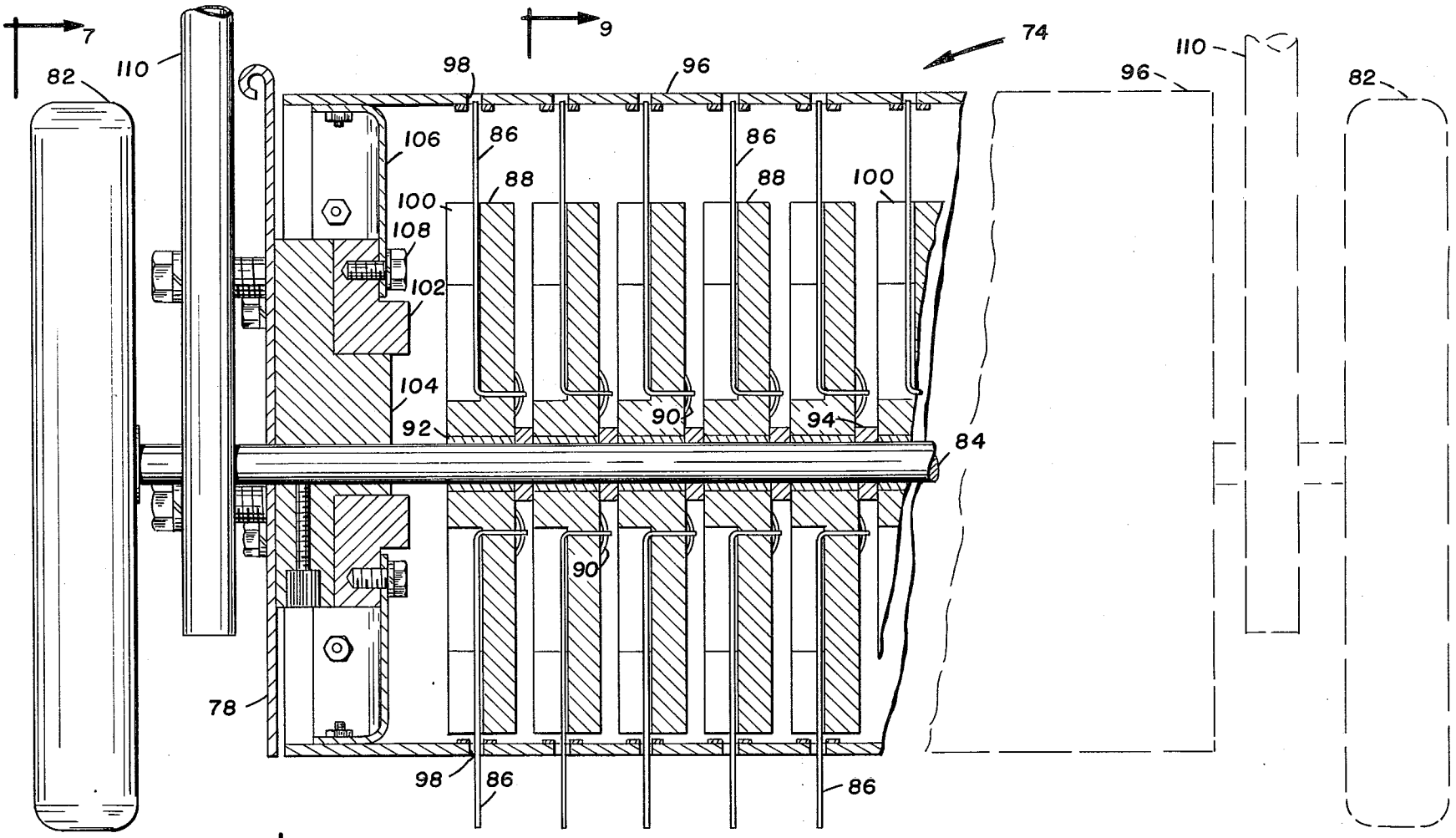
FIG. 6 is an elevation in partial section, with one end in phantom, of the second embodiment.
Figure 7:
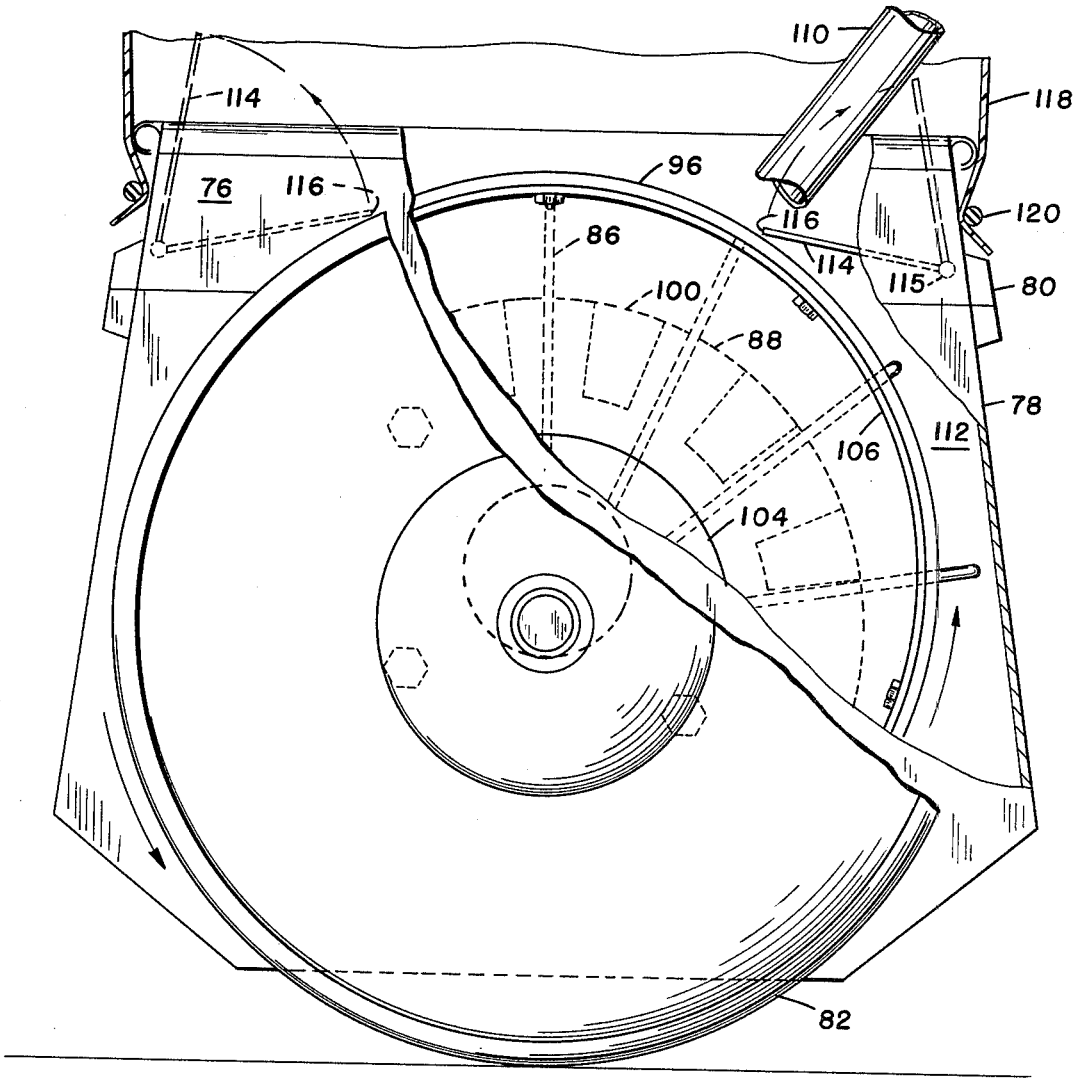
FIG. 7 is a partial section along line 7—7 of FIG. 6.
Figure 8:
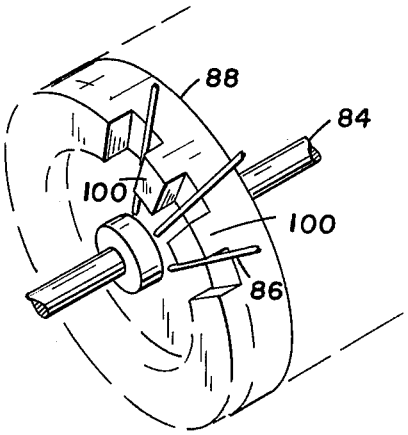
FIG. 8 is a perspective view of timing disk, of the second embodiment.
Figure 10:
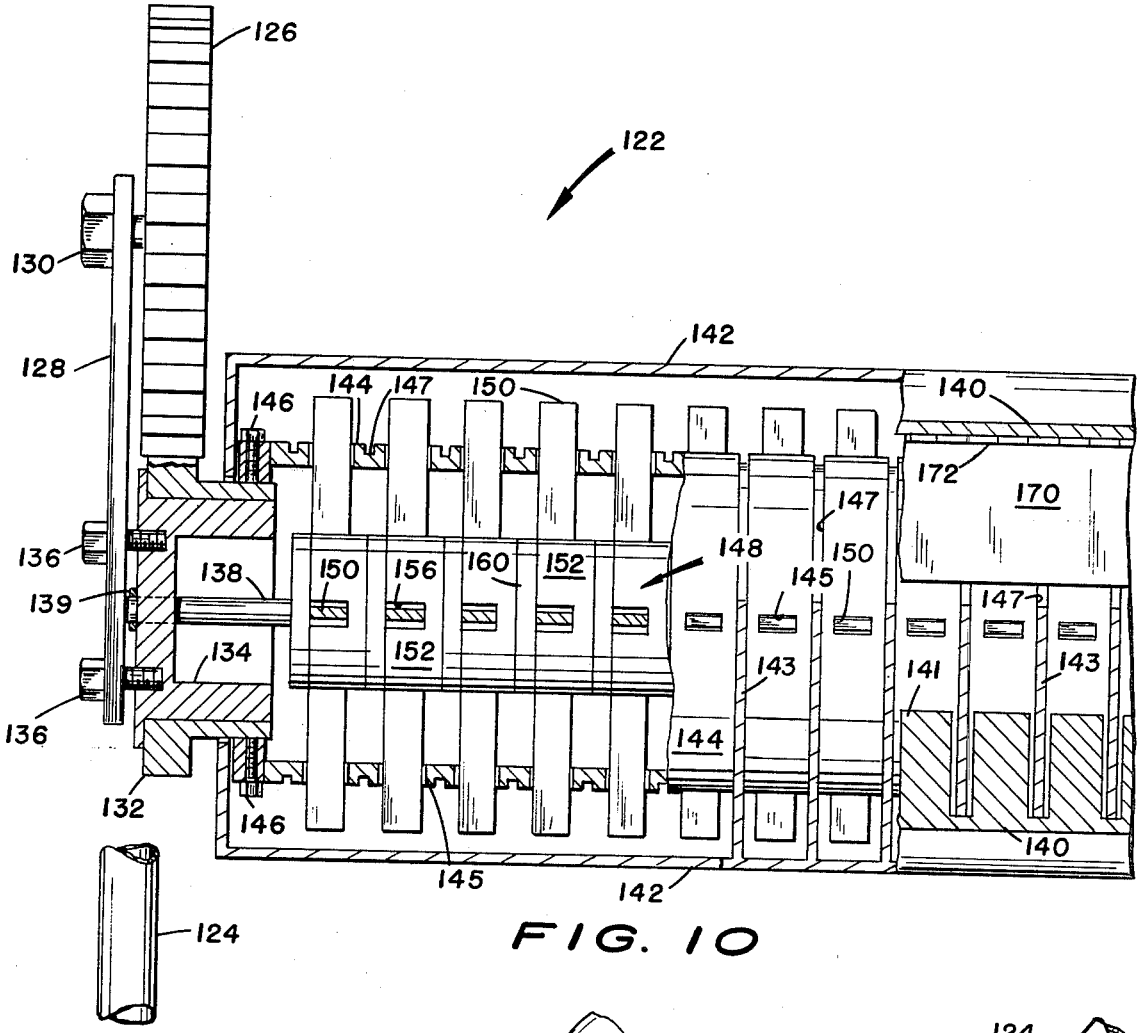
FIG. 10 is a top view in partial section, of the third embodiment.
Figure 11:
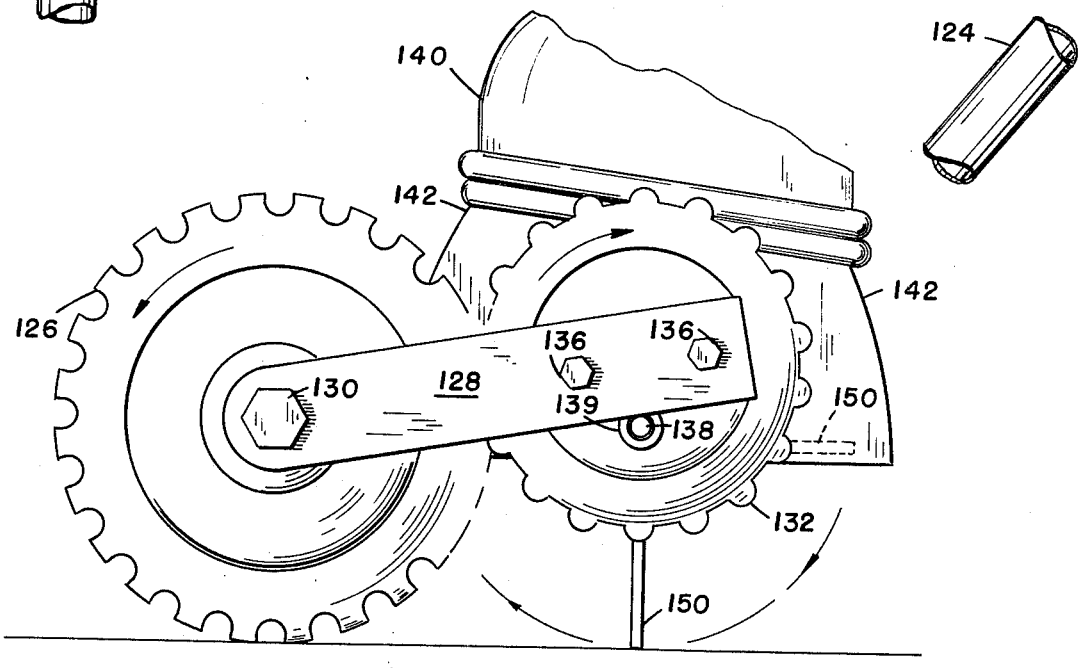
FIG. 11 is an end view in partial section, of the third embodiment.

Referring now to the drawings and particularly to FIGS. 1, 6, and 10 a first embodiment of a debris picker and bagger is seen at 10 in FIG. 1, a second embodiment is seen at 74 in FIG. 6, and a third embodiment is seen at 122 in FIG. 10. The three embodiments of the debris picker and bagger (10, 74, and 122) of this invention will be discussed, in turn, hereinafter.

Figure 2:
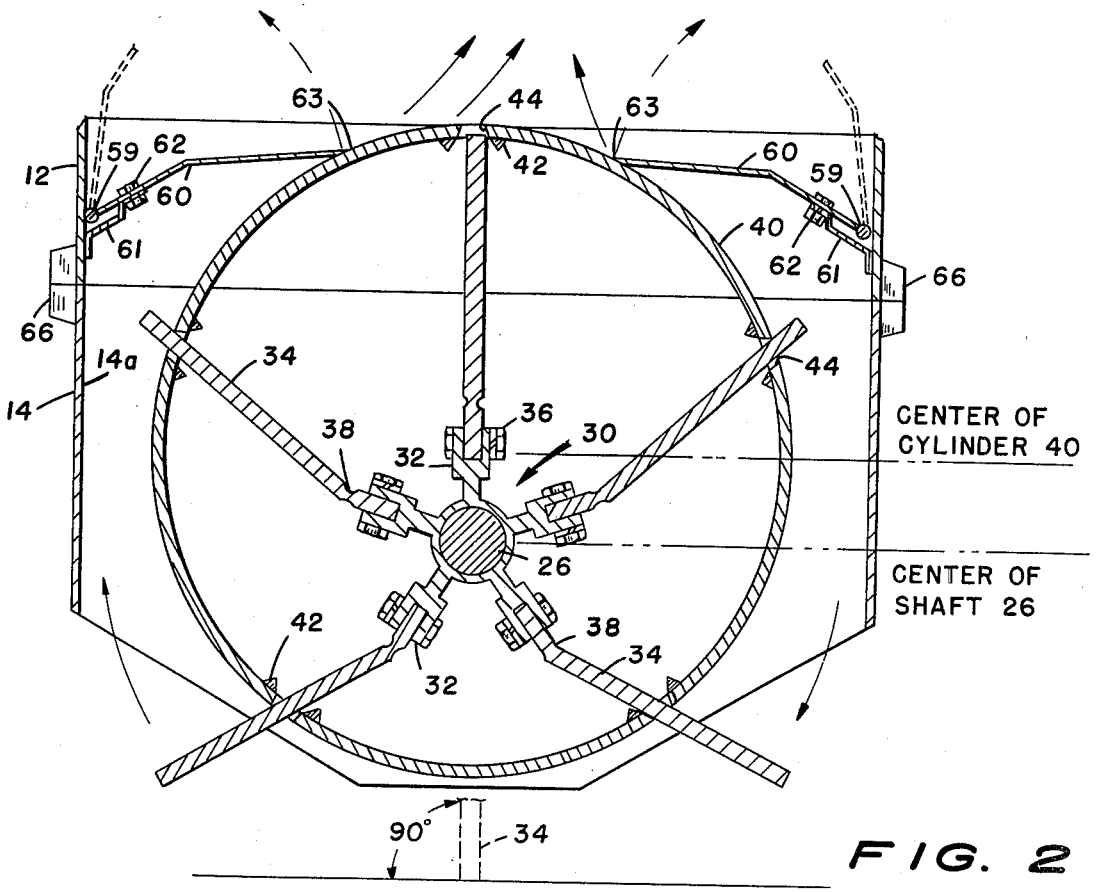
FIG. 2 is a section along line 2—2 in FIG. 1.
Figure 3:
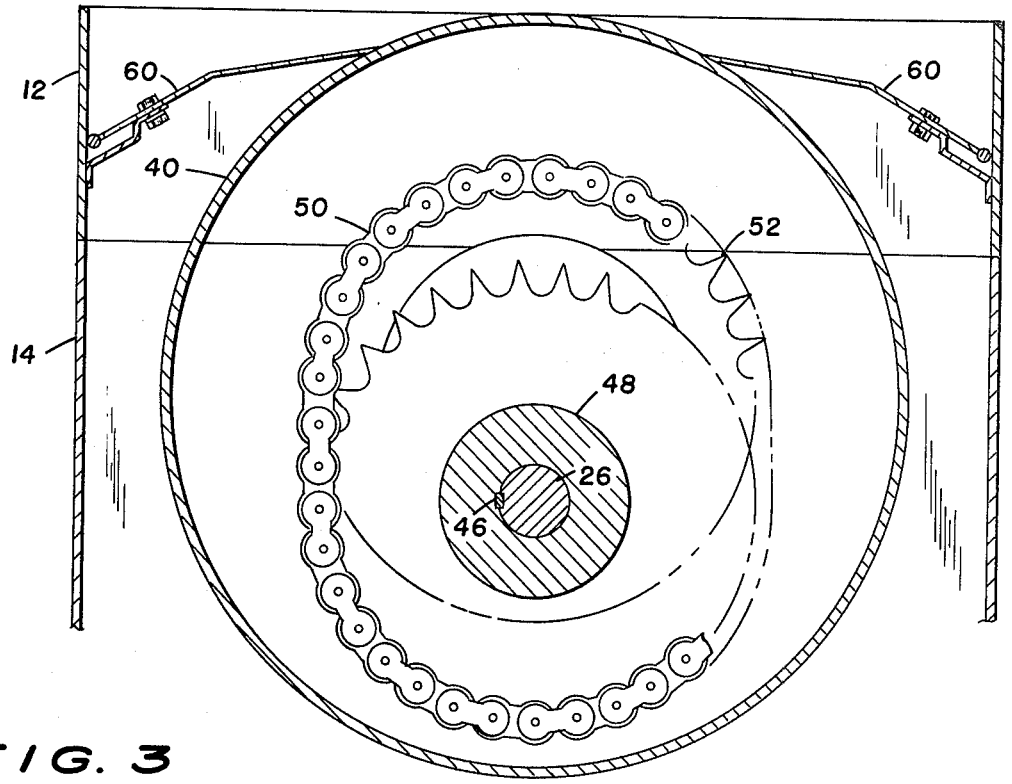
FIG. 3 is a section along line 3—3 in FIG. 1.

Referring first to FIG. 1 for the first embodiment, the debris picker and bagger 10 has a housing 14; in FIG. 2 it can be seen to be the lower housing 14, with an upper housing 12 attached to it by a latch 66 which attaches across the rolled edges (not numbered) of the upper housing 12 and the lower housing 14.

The lower housing 14 and the upper housing 12 serve to encase the drum mechanism (described in detail hereinafter) and to form a chute means to guide the picked up debris into a storage compartment (also described in detail hereinafter).

Describing first the drum mechanism, a cylindrical drum 40 is provided with a plurality of slots 44, five are shown for purposes of illustration in FIG. 2. Rake members 34 move inwardly and outwardly through the slots 44 (one bank of a plurality of rake members 34 for each slot 44) as described hereinafter. Each slot 44 is provided with a rake guide 42 on each longitudinal side of the slot 44. These rake guides are to prevent the rake members or fingers 34 from dropping out of the slots 44 as the drum mechanism turns during operation as hereinafter described. The rake guides 42 are of a triangular configuration to provide clearance for the rake member 34 as it pivots or deflects in relation to the relative position of the shaft 26, to which it is attached, and the position of the aforementioned slot 44. The longitudinal sides of slot 44 are at an angle to the inside and outside surfaces of drum 40, the slope being more or less a continuation of the side of the rake guide 42 adjacent to the slot 44. The slots 44 are parallel with the longitudinal axis of the drum 40 and long enough so that the entire bank of the ends of the rake-like members 34 may extend therethrough.

Extending through the drum 40, and outside the ends thereof, is a rake shaft 26. In operation, the horizontal centerline or axis of the shaft 26 is offset from the horizontal centerline or axis of the drum 40 as can be seen in FIG. 2.

Figure 4:
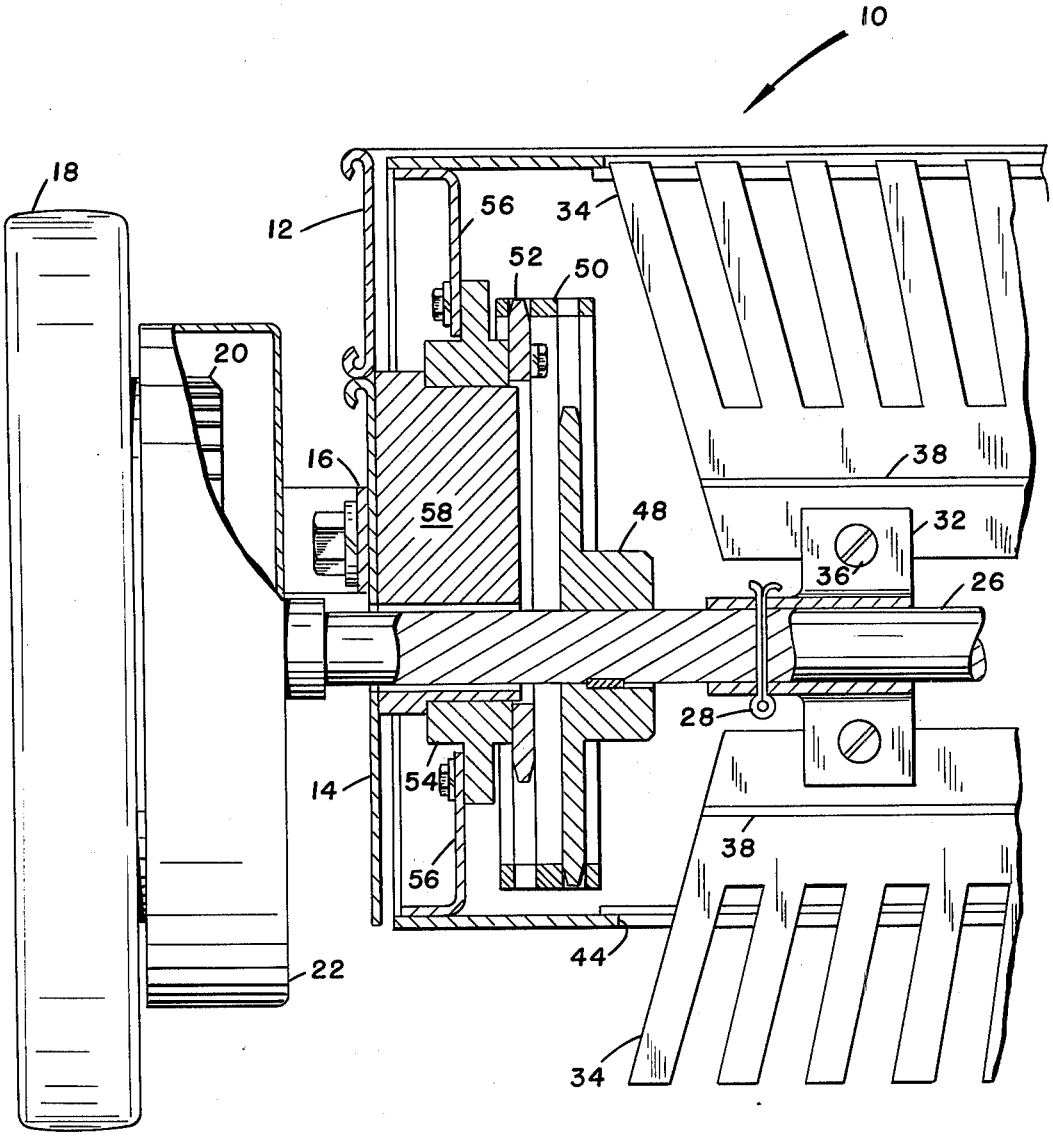
FIG. 4 is an elevation in partial section, of the first embodiment.

Rake members 34 are formed as a unit or bank of a plurality of such rake members 34 as can be seen in FIGS. 1 and 4. The plurality of rake members 34 formed as a unit (one such unit for each slot 44 in drum 40) have a common back-bone or bridge (not numbered) to which the plurality of rake members are attached. The unit of rake members 34 has flexible or hinged joint 38 so that the rake members 34 can bend during operation as the relative position of the shaft 26, to which they are attached, changes in relation to the slot 44 in drum 40.

The unit of rake members 34 is attached by the aforementioned bridge to a yoke 32 of a cluster mounting bracket 30. One such cluster mounting bracket 30 is near each end of shaft 26 so that each unit of rake members 34 can be attached or connected to the shaft 26 at two locations. It is to be understood that the use of one or more than two such cluster mounting brackets 30 is within the intent and scope of this invention.

The attachment of the unit of rake members 34 to the yoke 32 at each end is by a bolt, nut, and lock washer 36 at each such location.

The cluster mounting bracket 30 has an extension (not numbered) on one side of the hub thereof as can be seen in FIGS. 1 and 4. A cotter-pin 28 secures the cluster mounting bracket 30 to the shaft 26 at the extension of the hub by passing through said hub and said shaft 26. It is to be understood that the use of a nut and bolt, machine screw, pin, or similar arrangement in place of a cotter pin 28 is within the scope and intent of this invention.

It is to be understood that the provision of an extension (not numbered) on each side of the hub of the cluster mounting bracket 30 is within the scope and intent of this invention.

The rake members 34 may be metal, plastics, leather, or any similar material in which a flexible or hinged joint 38 can be formed.

The relative positions of the rake members 34 from the shaft 26 to the slots 44 can be seen in FIG. 2. At the beginning of the pick up when the rake members 34 of one of the units is vertically downward, the rake members will be at 90 degress to the ground or lawn as shown dotted in FIG. 2.

As the shaft 26 and drum 40 turns in the direction of arrows in FIG. 2, the debris is pushed up into the lower housing 14 along the inside surface 14*a*, then into the upper housing 12. As debris accumulates and packs into the upper housing 12 portion the retainer shelf 60, which is hinged at 59, is forced upward in the direction of the arrow and the debris then pass through the opening 63 while the retainer shelf 60 is open. When the retainer shelf 60 drops down into place by gravity it retains the debris above it. One such retainer shelf 60 is attached by a hinge 59 to the inside surface 14*a* of the front and rear walls of the upper housing 12. Stop brackets 61 are connected to each end of each retainer shelf 60 by a suitable bolt, nut, and lock washer 62. The hinge 59 is preferably a piano type.

Figure 5:
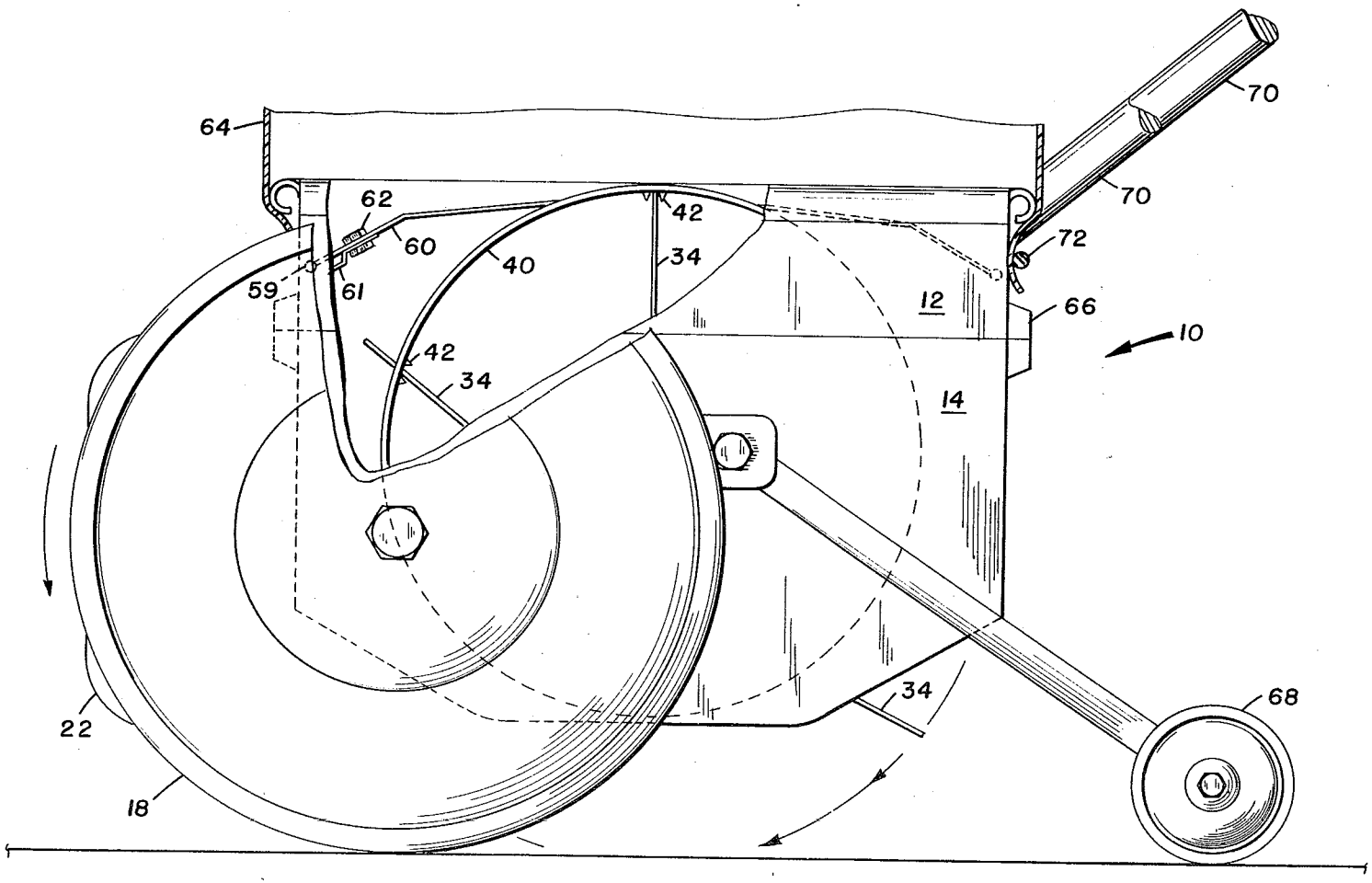
FIG. 5 is an end view in partial section, of the first embodiment.

The debris that pass through the opening 63 pass into the storage compartment above which is a disposable bag 64 (plastics or other suitable material). The open end of the disposable bag 64 is passed over the rolled top edges (not numbered) of the upper housing 12, as shown in FIG. 5, and held in place by a rubber-like cord-like band 72 around the disposable bag 64 to hold it tightly against the upper housing 12. It is to be understood that the use of plastics or metal or other similar bands or rubber-like bands of flat or configuration other than cord-like, is within the scope and intent of this invention.

A suitable handle means 70, as known in the art, is suitably attached to the rear side of the upperhousing 12 as shown in FIG. 5, for manually pushing the leaf picker and bagger 10 across the lawn or ground to collect leaves and other debris. Such a handle means 70 has two angular rising supports from the upper housing 12, to which they are suitably attached, and are connected together at the top ends thereof; the handle means 70 may be in a more or less "U" shaped configuration as is known in the art.

The handle means 70 also be collapsible or foldable, or detachable, as is known in the art. The handle means 70 may be lightweight tubular material, solid round bar, or other configuration without departing from the scope or intent of this invention.

Extending from the upper side or surface of the handle means 70 and attached thereto, is a framework or harness means (not shown) for supporting the disposable bag 64 in a vertically upward position while being filled.

The present invention is shown as a manually pushed device, however, it may be suitably connected to a power means (electrically or fuel driven) mounted on and attached to the device as is known in the art without departing from the scope and intent of the invention.

A pair of height adjusting wheels 68 is shown in FIG. 5, to regulate the angle and position of the rake-like members in relation to the lower portion of the picker and bagger 10, and to provide stable support for the picker and bagger 10, are suitably attached to each side of the lower housing 14 by a carrier bar (not numbered). The wheels 68 may each be on short stud-like axles, or on a common axle (not shown) across the back between the carrier bars (not numbered).

Turning now to the mechanism that turns or revolves the drum 40 and the shaft 26 with the attached rake-like members 34, refer to FIGS. 1 through 5.

A pair of wheels 18, as known in the art for lawn care equipment, provides the operating power for the drum 40 and the shaft 26 as the wheels 18 move across the lawn or ground when the picker and bagger 10 is pushed manually as hereinbefore described.

A drive gear 20 is attached concentrically to the inside of each of the pair of wheels 18. What is described hereinafter, will be for one of the two wheels 18 and the associated mechanism, one on each side of the lower housing 14, but applies to both of the wheels 18 and associated mechanism on each side of the lower housing 14.

A gear cover 22 covers the gear 20 (and a smaller gear 24, described later). The wheel 18 and gear 20 are carried on a stud-type axle (not numbered) with bearing that is fastened to the gear cover 22 by an axle nut and lock washer (not numbered). A bracket 16 is fastened to the gear cover 22 by two machine screws and lock washers (not numbered). The bracket 16, which is of goose-neck-like configuration, is fastened to the lower housing 14 with two machine screws and lock washers (not numbered). The bracket 16 holds the gear cover 22 (and the attached wheel 18 and gear 20) in place in relation to the lower housing 14. The hereinbefore described arrangement of the wheel 18, gear 20, gear cover 22, bracket 16, and the unnumbered stud-type axle and fastening machine screws and lock washers can be seen in FIG. 1.

The shaft 26 extends through the lower housing 14, through the gear cover 22 and carries the small gear 24 fastened on the end by means known to the art. The small gear 24 meshes with the gear 20 to provide the transfer of power to the shaft 26 and subsequently to the drum 40 as hereinafter described. A suitable bearing (unnumbered) for the shaft 26 is provided where the shaft 26 passes through and into the gear cover 22.

The aforementioned two machine screws and lock washers (not numbered) that fasten the goose-neck-like bracket 16 to the lower housing 14, pass through the lower housing 14 and into a sprocket bearing support 58. The two screws and lock washers (not numbered) thus fasten the sprocket bearing support 58 to the inside of the end wall of the lower housing 14. Note in the top view in FIG. 1 that the sprocket bearing support 58 is centered on the end wall of the lower housing 14 and centered on the centerline of the shaft 26 and the drum 40, and that the shaft 26 passes through a clearance hole (not numbered) in the sprocket bearing support 58. However, note in the elevation view in FIG. 4 that the sprocket bearing support 58 is off center in relation to the lower housing 14. The sprocket bearing support 58 in this elevation view in FIG. 4 is however centered on the centerline of the drum 40. In FIG. 4 it can be seen that the shaft 26 passes through the lower part of the sprocket bearing support 58.

A cup-shaped or flanged end plate 56 is fastened in the end of drum 40. It can be welded in place, fastened by countersunk machine screws at the flanged edges, or otherwise bolted or clip-fastened into place. The end plate 56 is shown fastened with a plurality of bolts, nuts, and lock washers (not numbered) in FIG. 1. This end plate serves as a support connection of the cylindrical drum 40 to its sprocket bearing 54.

The end plate 56 is connected to the drum sprocket bearing 54 by a plurality machine screws and lock washers (not numbered) as seen in FIGS. 1 and 4.

A drum sprocket 52 is fastened to the inboard face of the drum sprocket bearing 54 by a plurality of machine screws and lock washers (not numbered). As the sprocket is turned by the double chain 50, as hereinafter described, it turns the drum sprocket bearing 54 and, in turn, revolves the drum 40 by its fastening to the end plate 56.

A rake shaft sprocket 48 serves as the power drive for the drum sprocket 52. The rake shaft sprocket 48 is fastened to the shaft 26 by a key 46 in companion keyways (not numbered) in the hub of the rake shaft sprocket 48 and the shaft 26. The double chain 50 passing around the lower part of the rake shaft sprocket 48, turns the drum sprocket 52 by passing around the upper part of the drum sprocket 52. Uniquely, no intermediate in-line sprockets are used, requiring a two-chain arrangement, the single double chain provides the power transfer.

Thus the train of power from the wheels 18 to the drum 40 and the rake-like members 34 is: when the debris picker and bagger 10 is pushed manually, the turning of the wheels 18 turns gears 20, which turns small gear 24; small gear 24 turns shaft 26 and this moves the double chain 50 and simultaneously revolves the rake-like members 34 fastened to the shaft 26; the movement of the double chain 50 turns drum sprocket 52; which turns the drum sprocket bearing 54; the turning drum sprocket bearing 54 turns the end plate 56 with it and this revolves the drum 40.

As the drum 40 and rake-like members 34 revolve simultaneously, the off-center relationship of the longitudinal centerline of the drum 40 and the longitudinal centerline of shaft 26 results in the ends of the rake-like members 34 moving in and out of the slots 40. As the rake-like members 34 move inward into the slots 40 as the revolving rake-like members reach the top-most position the action has a wiping effect to clear any debris from the rake-like members 34 and concurrently compresses the debris upward as more debris is brought in below. The debris move upward and through opening 63 into the disposable bag 64 as hereinbefore described.

Referring now to FIG. 6 for the second embodiment of the debris picker and bagger 74, the operation is somewhat similar to the operation of the first embodiment except as otherwise described herein. As previously, the mechanism will be described for one side only and it is to be understood that similar mechanism is on both sides of the picker and bagger 74.

The second embodiment of the debris picker and bagger 74 has wheels 82, similar to the aforementioned wheels 18. The picker and bagger 74 is pushed manually by the handle 110 which is similar to the aforementioned handle 70. The handle 110 is suitably attached to the picker and bagger 74 by machine screws, lock washers, and spacers (not numbered). When the picker and bagger 74 is pushed manually, the wheels 82 rolling on the ground turn freely on the shaft 84 as an axle. Shaft 84, which is stationary, is also the shaft for the debris picker and bagger 74 mechanism described hereinafter.

It is to be noted that in the picker and bagger 74, the turning of wheels 82 turn in the same direction as the drum and rake members (to be identified and described hereinafter) because of the direct contact with the ground by the wheels 82 and spikes 86 (described hereinafter) and both arranged to turn on the stationary shaft 84.

Whereas in the first embodiment the movement of the wheels 18 was opposite to the turning direction of the drum 40 and the rake members 34, because of the gear 20 and pinion 24 transfer of power.

The debris picker and bagger 74 has a lower housing 78 and an upper housing 76 that are held together by latch 80. The lower housing 78 and upper housing 76 are comparable to the aforementioned lower housing 14 and upper housing 12, except for the slightly modified configuration. The upper and lower housings 76 and 78 respectively serve essentially the same purpose as the upper and lower housings 12 and 14 respectively. The latches 80 are comparable to the latches 66.

A disposable bag 118 is fastened to the upper housing 76 by a rubber-like cord-like band 120, all similar to the disposable bag 64 and band 72 aforementioned.

It is to be noted that references to power means, varying materials, and other such matters that were within the scope and intent of the invention as referenced to the first embodiment, also apply to the second and third embodiments as well.

A drum bearing support 104 is fastened to the inside of the side wall of the lower housing 78 by machine screws and lock washers (not numbered) from the outside surface of the side wall of the lower housing 78. The drum bearing support 104 is centered on the longitudinal center line of the cylindrical drum 96. The stationary shaft 84 passes through the drum bearing support 104. The shaft 84 is held stationary by a set screw (not numbered).

The cylindrical drum 96 has a plurality of holes or round apertures 98, one for each spike 86 of the plurality of spikes 86 described hereinafter. Each aperture 98 is surrounded on the inside by a guide collar (not numbered) to keep the spikes 86 from slipping out of the apertures 98 when the apertures 98 are at the top of the revolution and the spikes 86 are at the withdrawn position. The guide collars (not numbered) are similar in purpose to the rake guides 42.

The plurality of spikes 86 are attached to timing discs 88, twelve are illustrated as attached to each timing disc. It is to be understood that any number may be attached to a timing disc and any such variation is within the scope and intent of the invention.

The timing disc 88 has a series of pad-like blocks 100 on one side, spaced around the periphery of the disc 88. Each of the spikes 86 on each disc 88 fit between two adjacent pad-like blocks 100. The spikes 86 are mounted on the disc 88 by having one end of the spike 86 bents at 90 degrees (not numbered) to the spike 86 and the bent end passing through the disc 88 and being secured by a retainer washer 90 on the end that passes through the disc 88 (see FIG. 6). Said spikes 86 are flexible and can deflect or pivot in a hinge-like manner under pressure.

Each disc 88 has a self-lubricating bearing 92 at the center so that the disc 88 can rotate freely around the stationary shaft 84. Each circular disc 88 is separated by a spacer 94 to provide clearance for the retainer washer 90. A collar (not shown) may be placed at each end of the bank of discs 88 so that the discs remain in the proper relative position to the apertures 98 for the spikes 86.

The end plate 106 and drum bearing 102 for the second embodiment is installed in a manner comparable to the end plate 56 and drum bearing 54 of the first embodiment. The cup shaped end plates 106 are secured to the inside of the ends of drum 96 by a plurality of countersunk bolts, nuts, and lock washers (not numbered). A plurality of machine screws and lock washers 108 fastens the end plate 106 to the drum bearing 102. Thus, supported by the end plate 106, the drum bearing 102 can turn and revolve on the drum bearing support 104 as the drum 96 revolves.

In a manner similar to the operation of the first embodiment, leaves being picked up by the spikes 86 and passed up into the channel area 112, between the inside of the rear wall 112 and the outside surface of drum 96, are pushed and compacted against the debris retainer plate 114. As the leaves increase, the debris retainer plate 114 raises on hinges 115 (preferably a piano type) to provide an opening 116 through which the debris passes into the disposable bag 118. Gravity closes the debris retainer plate 114 when no debris is passing through in order to hold the collected debris in the disposable bag 118.

Figure 9:
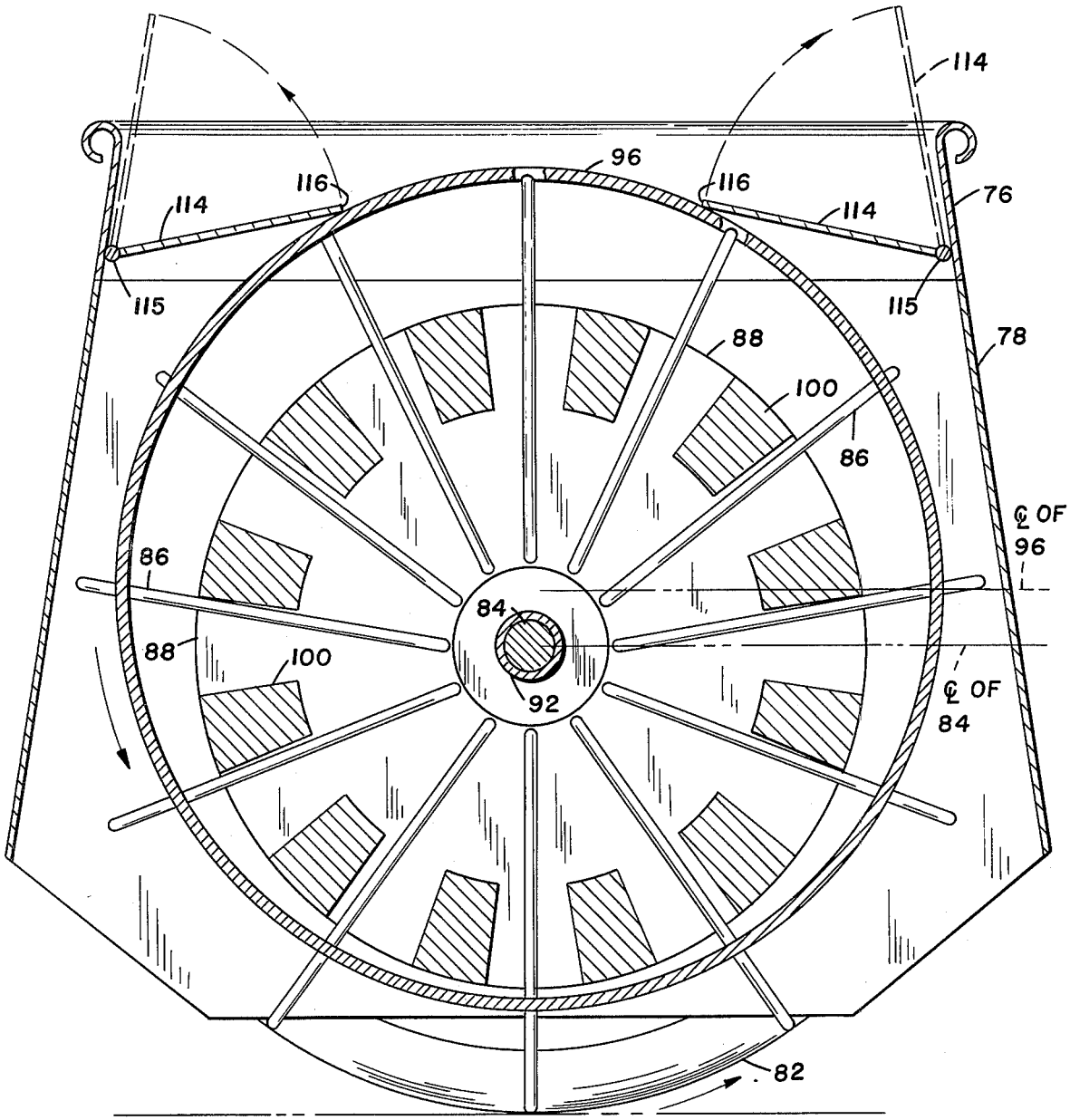
FIG. 9 is a section along line 9—9 of FIG. 6.

Note in FIG. 9 that the horizontal centerline or axis of shaft 84, about which the plurality of spikes or the plurality of discs 88 revolve, is off center in relation to the horizontal center line or axis of the drum 96. As the leaf picker and bagger 74 is manually pushed along on a lawn or the ground the spikes protruding from the drum 96 at the bottom spear or spike debris, as well as "sweep " or "rake" debris without spearing or spiking and in the revolving process force and carry the debris up into the channel area 112 as hereinbefore mentioned.

The operation of the second embodiment occurs as the debris picker and bagger 74 is manually pushed along. The spikes 86 "walk" along the lawn or ground and as successive spikes 86 meet the lawn or ground as they "walk" the discs 88 turn freely on the shaft 84. The aforementioned off center relation of shaft 84 and the drum 96 causes the spikes to move in and out of the apertures 98 similar to action in the first embodiment. As this occurs any debris speared or spiked by the spikes 86 at the ground level are wiped off as the spikes 86 are withdrawn into the drum 96 as the apertures 98 approach the top position.

As the discs 88 rotate with the spikes 86, the spikes 86 push against the pad-like blocks 100 and extending through the apertures 98 push against the sides of the apertures and thus force it to rotate also, and in due course cause the "wiping" action aforementioned.

Turning now to the third embodiment of the picker and bagger 122 as shown in FIGS. 10 through 14, the operation is more or less a combination of the principles of both the first and the second embodiments. Many parts of the third embodiment are similar to these other embodiments and operate in a similar manner for the same purpose. To conserve time and space the following similarities are noted and no further description will be presented.

Handle 124 is similar to handle 70 and handle 110 except for a bag harness 180 as later described; upper housing 140 is similar to upper housing 12 except that it is projected to carry a disposable bag in a more or less horizontal position as later described, said housing 140 has tines 141; lower housing 142 is similar to lower housing 14, except for a slight change in configuration and the addition of tines 143; a latch (not shown) is provided similar to latch 66; disposable bag 174 is similar to disposable bag 64; rubber-like cord-like band 178 is similar to rubber-like cord-like band 72; debris retaining shelf 170 on the forward side of the picker and bagger 122 is similar to debris retaining shelf 114; and preferably a piano type hinge 172 is similar to hinge 115.

The exit end of upper housing 140 is curved toward the rear and slightly canted. The disposable bag 174 is attached to the upper housing 140 in a manner similar to that in the second embodiment with a rubber-like cord-like band 178. When so attached, the bag 174 extends more or less horizontally toward the rear and is supported by harness 180 attached to the underside of handle 124, particularly as it is loaded with leaves and debris.

The power input, as the picker and bagger 122 is manually pushed across a lawn or the ground, provides the movement or rolling of the wheelgear 126, a combination wheel and gear. The wheelgear 126 meshes with a second gear 132 as a power take off, with teeth shaped and designed to mesh with the shape of the teeth in the wheelgear 126. Power and the revolving of wheelgear 126 is transmitted to gear 132. Gear 132 has an extended hub on the inboard side for connection to the cylindrical drum 144 as hereinafter described.

Shaft 138 passing through the operating mechanism, as described hereinafter, extends out at each end to carry gear bearing 134. Gear bearing 134 is held on the shaft 138 by retaining clip 139.

Thus as wheelgear 126 rolls, it turns gear 132 riding on gear bearing 134. The wheelgear 126 is fixed in place by the bracket 128 which is attached at one end to the wheel bearing 134 by two machine screws 136, lock washers (not shown) may be used to secure the machine screws 136 in place. The other end of the bracket 128 is attached to the wheel gear 126 by a stud-type axle held by a machine screw 130. A lock washer (not shown) may be used to secure the machine screw 130 in place.

Figure 12:
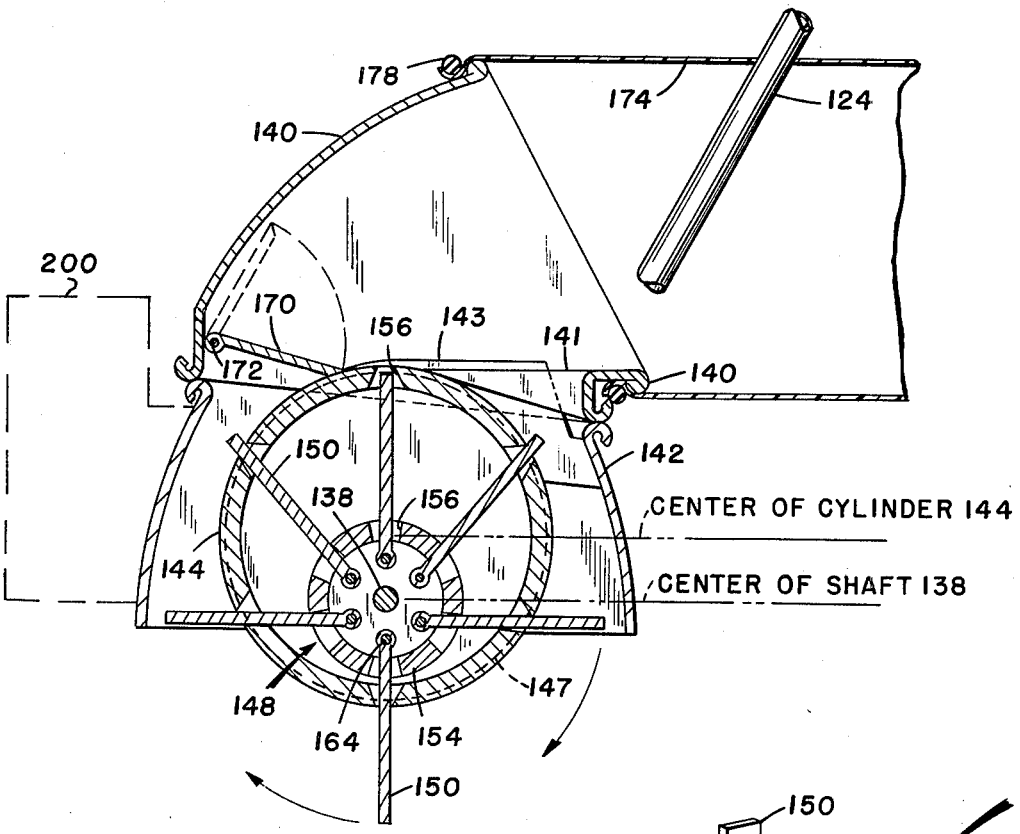
FIG. 12 is a cross section view through the center of drum mechanism, of the third embodiment.
Figure 13:
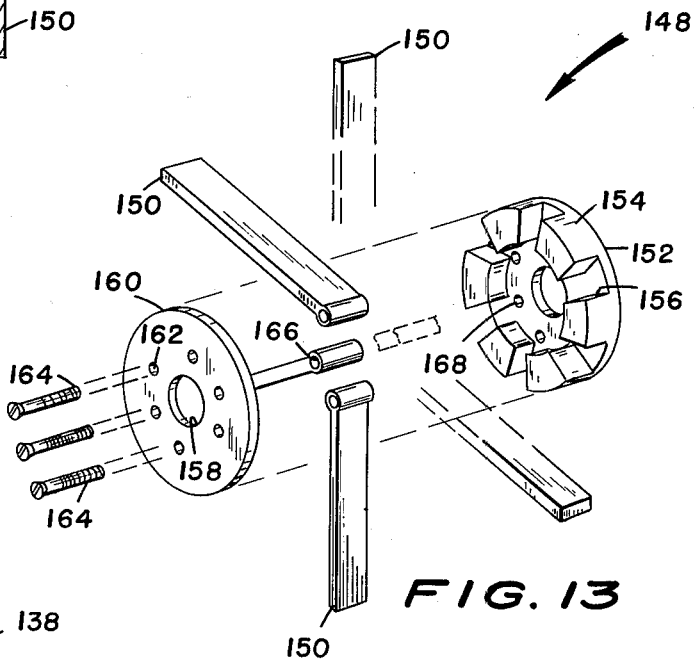
FIG. 13 is an exploded view of the rake member and hub-assembly, of the third embodiment.
Figure 14:
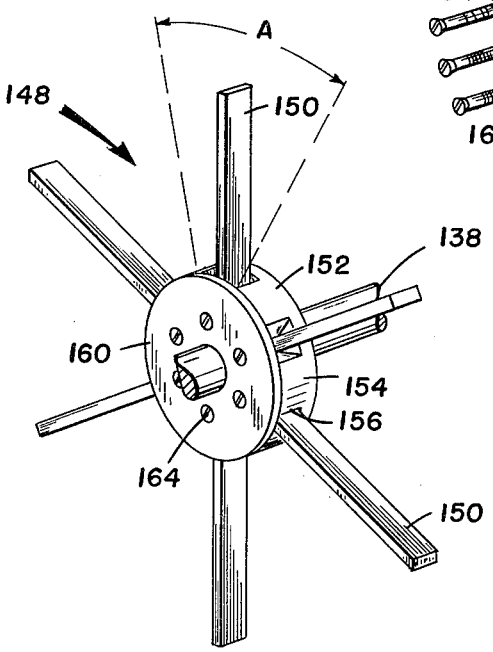
FIG. 14 is a perspective view of the rake-member and hub assembly of the third embodiment.
Figure 15:
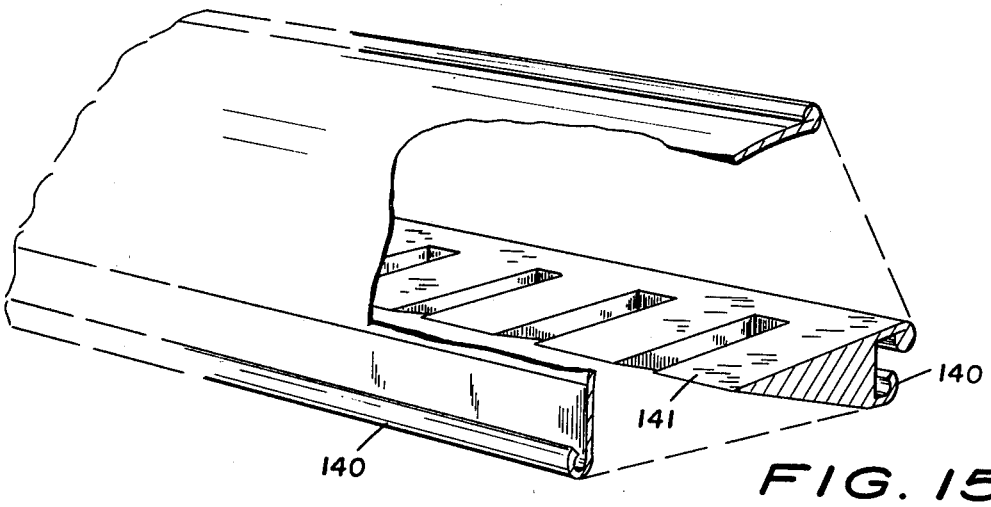
FIG. 15 is a perspective view showing the bag in a harness attached to the underside of handle of the third embodiment.
Figure 16:
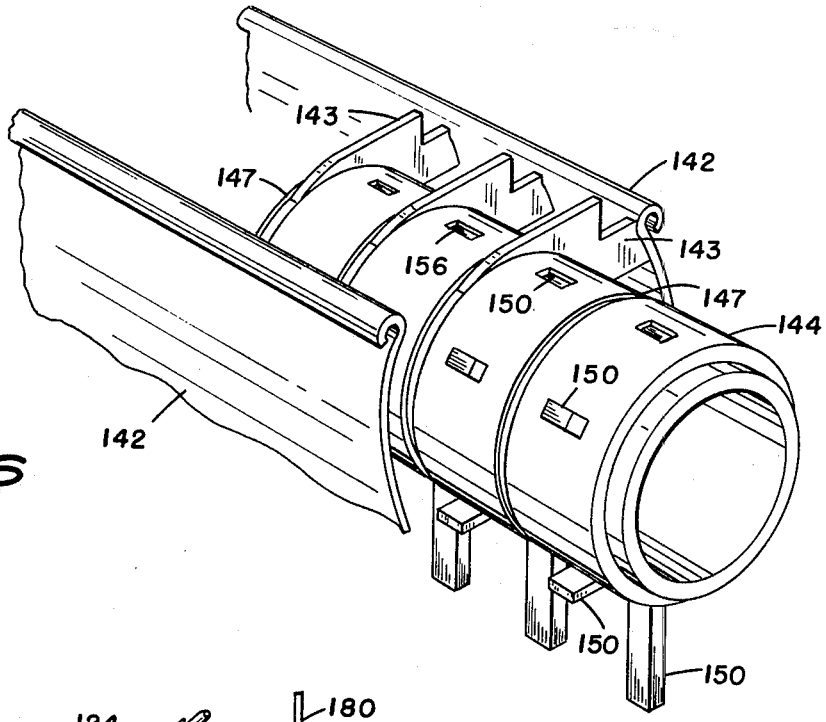
FIG. 16 is a perspective view showing tines of lower housing of third embodiment.
Figure 17:
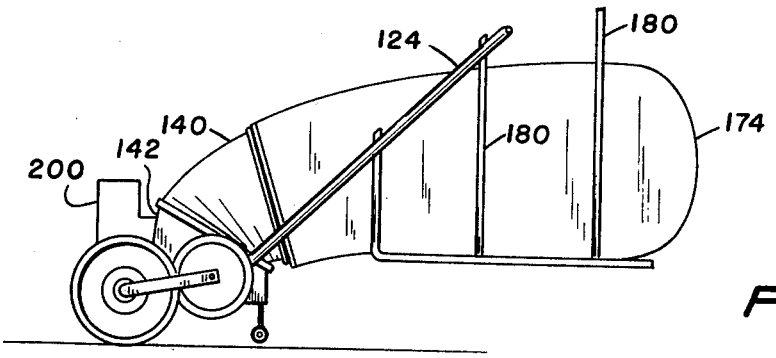
FIG. 17 is a perspective view showing tines of upper housing of third embodiment.

Note in FIG. 12 that the horizontal centerline or axis of the shaft 138 is offset from the horizontal centerline or axis of the cylindrical drum 144.

Cylindrical drum 144 is enclosed at the ends with a plate (not numbered) through which at least two set screws 146 pass to secure the drum 144 to the extended hub of gear 132.

The drum 144 has a plurality of rectangular slots or apertures 145 through which the rake members 150 move during operation of the picker and bagger 122. The rectangular apertures 145 are aligned in rows to match the lines of the plurality of rake members 150. The rectangular aperture 145 are tapered inwardly to provide for freedom of movement of the rake member 150 as the rake member moves or flexes as shown by "A" in FIG. 14.

The drum 144 has a plurality of spaced slots or grooves 147 around the outside periphery of said drum 144, said slots or grooves 147 spaced so that each rectangular aperture 145 is approximately centered between two adjacent said spaced slots or grooves 147.

Spaced tines 143 attached to lower housing 142 ride in grooves 147, the ends of said tines 143 riding in grooves 147 below outside surface of drum 144.

Spaced tines 141 attached to upper housing 140 ride on the outside surface of drum 144, each said tine 141 being centered between adjacent pairs of tines 143.

The tines 141 and 143 are shown permanently attached to said housings 140 and 142 respectively, however, it is to be understood that they may be hinged to said housings 140 and 142. Said combination of tines 141 and 143 act in same capacity as the rear leaf container plate 114 in the second embodiment.

The rake members 150 are of rectangular cross section and at one end is equipped with cylindrical passageway 166 therethrough. A plurality of rake members 150 are assembled on a timing disc 152 with pad-like projections 154 similar to the timing disc 88 with pad-like projections 100. The rake members 150 are assembled to the disc 152 by a plurality of countersunk machine screws 164 that serve as a pivot pin after assembly (one for each rake member 150). Each rake member 150 is assembled by passing the machine screw 164 through an aperture 162 in a cover plate 160, then through the cylindrical passageway 166 at the end of the rake member 150 and screwing the threaded end of the machine screw 164 into the threaded hole 168 in the disc 152. Each rake member 150 is set in the space 156 between two adjacent pad-like projections 154 on the disc 152.

Each such rake assembly 148, as described hereinbefore, is then assembled to the shaft 138 by passing the shaft 138 through the aperture 158 in the center of the cover plate 160 and a similar aperture (not numbered) in the disc 152.

In operation, as the debris picker and bagger 122 is pushed across a lawn or the ground, wheelgear 126 turns by rolling over the lawn or ground. Wheelgear 126 meshes with and turns gear 132. Gear 132, being held fast to drum 144 by set screw 146 turns drum 144 so that it revolves. As it revolves the pressure of the aperture 145 faces against the rake members 150 and coupled with the pressure of the rake members 150 against the pads 154 of the disc 152 of the rake assembly 148 the plurality of rake assemblies 148 revolves around the shaft 138 on which the rake assemblies 148 turn freely. As the rake members 150 revolve, they sweep up the leaves into the space between the lower housing 142 and the drum 144 and thence through the opening when debris retainer shelf 170 is forced open as hereinbefore described for the first and second embodiments.

As the drum 144 and rake assemblies 148 revolve, the rake members 150 move in and out through the apertures 145 in the drum 144 in the manner as the rake members 34 in the first embodiment and the spikes 86 in the second embodiment operate.

As the leaves and debris enter through the opening at debris retainer shelf 170 the debris passes into the disposable bag 174 stretched out horizontally to the rear of the upper housing 140. The tines 143 riding in grooves 147 and the tines 141 riding on the drum 144 act as a rear shelf to prevent the leaves and debris from passing around the drum and thus are forced and compacted into the disposable bag 174.

When full, the loaded disposable bag 174 is removed by releasing the cord-like band 178 and replaced with an empty bag 174.

As can be readily understood from the foregoing description of the invention, the present structure can be configured in different modes to provide the ability to sweep and collect debris from a lawn or the ground.

Accordingly, modifications and variations to which the invention is susceptible may be practiced without departing from the scope and intent of the appended claims.

What is claimed is:

1. A device for collecting debris from the ground and depositing said debris in a disposable container, comprising:

support wheels, said support wheels being spaced apart, and mounted on axle means;

a housing means, said housing means being located between and connected to said support wheels;

a handle means, said handle means being for manually pushing said device, said handle means attached to the combination of said support wheels and said housing means;

a cylindrical drum means, said drum means having spaced slots therein, said slots being located in the wall of said cylindrical drum means;

a straight shaft means;

a plurality of spaced debris raking means, said debris raking means being pivotally mounted on said shaft means, said pivotally mounted debris raking means providing a flexible movement to said debris raking means, said shaft means being located within and attached to said cylindrical drum means, the ends of said plurality of spaced debris raking means extending through said spaced slots, each said debris raking means having a designated slot through which it extends, the longitudinal center line of said drum means being located eccentrically in relation to the longitudinal center line of said shaft means of said debris raking means, said cylindrical drum means with said debris raking means and shaft means therein mounted within and remotely connected to said housing means;

means for transmitting motion to said debris raking means and said cylindrical drum means; and a disposable container means, said disposable container means for receiving and holding said debris, said disposable container means being removably connected to said housing means and communicating therewith, said housing means serving as a chute means to direct said debris into said disposable container means.

2. A device for collecting debris from the ground and depositing said leaves in a disposable container, comprising:

a pair of support wheels spaced apart and each mounted to a bracket, said wheels being a combination wheel and gear, with gear teeth being in the tread portion of said support wheels;

a pair of power take-off gears spaced apart and meshing with said pair of combination wheel and gears and connected thereto by said bracket, and mounted on a fixed shaft;

a plurality of spaced debris raking means on rotatable carriers mounted on said fixed shaft between said pair of power take-off gears;

a rotatable cylindrical drum means surrounding said debris raking means, with spaced apertures therein to permit ends of said debris raking means to extend therethrough, said cylindrical drum means being eccentrically located in relation to said fixed shaft;

a housing means surrounding said cylindrical drum means and remotely connected to said fixed shaft, said housing means forming a chute means to conduct collected debris into a disposable container;

a disposable container means for receiving and holding said collected debris removably connected to said housing means and communicating therewith;

a handle means for manually pushing said device for collecting debris, said handle means being attached to said housing means, said handle means having a holding structure for said disposable container attached to the underside thereof;

a plurality of tine-like members attached to said housing means and interfacing with said drum means to separate debris from said drum means and to direct said debris into said disposable container.

3. The device for collecting debris recited in claim 2, wherein said power take-off gears have specially shaped and configured gear teeth to fit into and between specially shaped and configured gear teeth in tread portion of said support wheels.

4. The device for collecting debris recited in claim 2, wherein said plurality of spaced debris raking means are mounted on said rotatable carriers so that each said debris raking means can move within said rotatable carrier in a hinged-like manner so as to deflect under pressure.

5. The device for collecting debris recited in claim 2, wherein said plurality of spaced debris raking means is divided into a plurality of equal groups and each said group is mounted on one of said rotatable carriers, all said rotatable carriers being contiguously mounted on said fixed shaft.

6. The device for collecting debris recited in claim 2, and additionally a hinged debris retaining means controlling the movement of debris from said chute to said disposable container means.

7. The device for collecting debris recited in claim 2, and additionally latch means, said housing means comprising a lower housing and an upper housing attached and secured to each other by said latch means.

8. The device for collecting debris recited in claim 7, wherein said plurality of tine-like members attached to said housing means and interfacing with said drum means to separate debris from said drum means to direct said debris into said disposable container, consists of a first plurality of first tine-like members attached to said lower housing, said first tine-like members interfacing with said drum means in a plurality of grooves on the periphery of the outside surface of said drum means, and a second plurality of second tine-like members attached to said upper housing that interfaces with said drum means on the periphery of the outside surface of said drum means between said grooves on the periphery of the outside surface of said drum means, one tine-like member of second plurality of tine-like members being located between each pair of adjacent tine-like members of first plurality of tine-like members.

9. The device for collecting debris recited in claim 1, wherein said disposable container means is a plastic bag.

10. A device for collecting debris from the ground and depositing said debris in a disposable container comprising:

support wheel means, said support wheel means being spaced apart and mounted on axle means;

a housing means, said housing means being positioned between and connected to said support wheel means;

a handle means, said handle means being for manually pushing said device, said handle means attached to the combination of said support wheel means and said housing means;

a cylindrical drum means, said cylindrical drum means having spaced slots therein, said slots being located in the wall of said cylindrical drum means;

a straight shaft means;

a plurality of debris raking means, said debris raking means being pivotally mounted on said shaft means, said pivotally mounted debris raking means providing a flexible movement to said debris raking means, said shaft means being located within and attached to said cylindrical drum means, the ends of said plurality of spaced debris raking means extending through their respective slots in said cylindrical drum means, the longitudinal center line of said drum means being located eccentrically in relation to the longitudinal center line of said shaft means of said debris raking means, said cylindrical drum means with said debris raking means and said shaft means therein mounted within and remotely connected to said housing means;

means for transmitting motion to said debris raking means and said cylindrical drum means; and a disposable container means, said disposable container means being for receiving and holding said debris, said disposable container means being removably connected to said housing means and communicating therewith, said housing means serving as a chute means to direct said debris into said disposable container means.

11. A device for collecting debris from the ground and depositing said debris in a disposable container, comprising:

supporting wheel means, said supporting wheel means being spaced apart and mounted on axle means;

a housing means, said housing means being positioned between and connected to said support wheel means;

a cylindrical drum means, said cylindrical drum means having spaced slots therein, said slots being located in the wall of said cylindrical drum means;

a straight shaft means;

a plurality of debris raking means, said debris raking means being pivotally mounted on said shaft means, said pivotally mounted debris raking means providing a flexible movement to said debris raking means, said shaft means being located within and attached to said cylindrical drum means, the ends of said plurality of spaced debris raking means extending through specific slots of said spaced slots in said cylindrical drum means, the longitudinal center line of said drum means being located eccentrically in relation to the longitudinal center line of said shaft means of said debris raking means, said cylindrical drum means with debris raking means and said shaft means therein mounted within and remotely connected to said housing means;

power means for transmitting motion to said debris raking means for said cylindrical drum means, said power means being mounted on said housing means and connected to said cylindrical drum means and said debris raking means;

a handle means, said handle means being for guidance and control of said device, said handle means being suitably attached to said housing means; and a disposable container means, said disposable container means being for receiving and holding said debris, said disposable container means being removably connected to said housing means and communicating therewith, said housing means serving as a chute means to direct said debris into said disposable container means.

* * * * *